US005697564A

United States Patent [19]

Ballardini

[11] Patent Number: 5,697,564

[45] Date of Patent: Dec. 16, 1997

[54] ASSEMBLY FOR SEPARATING MILLING ELEMENTS FROM A WORKED SUSPENSION

[75] Inventor: Graziano Ballardini, Faenza, Italy

[73] Assignee: Lonza S.P.A., Milan, Italy

[21] Appl. No.: 501,026

[22] PCT Filed: Nov. 25, 1994

[86] PCT No.: PCT/EP94/03900

§ 371 Date: Sep. 14, 1995

§ 102(e) Date: Sep. 14, 1995

[87] PCT Pub. No.: WO95/16519

PCT Pub. Date: Jun. 22, 1995

[51] Int. Cl.[6] ..... B02C 17/18

[52] U.S. Cl. ..... 241/171; 241/172

[58] Field of Search ..... 241/171, 172, 241/74; 29/785, 24.5; 209/281, 282, 283; 210/384, 385, 388; 30/454, 455, 453; 33/292, 247, 248, 249; 359/425, 426, 427, 408, 406, 399; 70/324, 296, 302

[56] References Cited

U.S. PATENT DOCUMENTS

| | | | |
|---|---|---|---|
| 842,076 | 1/1907 | Burnett | 70/324 X |
| 1,753,685 | 4/1930 | Bodenstein | 241/171 X |
| 2,095,228 | 10/1937 | Burns | 70/324 X |
| 2,189,312 | 2/1940 | Frisch | 241/171 X |
| 3,086,586 | 4/1963 | Wolfe | 29/24.5 X |
| 3,904,133 | 9/1975 | Bicik et al. | 241/171 X |

FOREIGN PATENT DOCUMENTS

| | | | |
|---|---|---|---|
| 1342334 | 9/1963 | France . | |
| 2446341 | 1/1982 | Germany . | |
| 2631623 | 6/1985 | Germany . | |
| 649861 | 12/1962 | Italy | 359/425 |
| 704661 | 12/1979 | U.S.S.R. | 241/171 |
| 4870 | of 1883 | United Kingdom | 359/425 |

*Primary Examiner*—Mark Rosenbaum
*Attorney, Agent, or Firm*—Fisher, Christen & Sabol

[57] ABSTRACT

An assembly for separating milling elements from a worked suspension, having several parts which are movable with respect to each other. Slots are formed between the parts. Neighboring moving parts engage each other, thereby being able to perform a limited relative movement in such a way that a first moving part is continuously moved within its total range of movement, with the other moving parts successively following in a delayed, chain reaction-like discontinuous movement.

22 Claims, 4 Drawing Sheets

ASSEMBLY FOR SEPARATING MILLING ELEMENTS FROM A WORKED SUSPENSION

BACKGROUND OF THE INVENTION

FIELD OF THE INVENTION

The invention relates to an assembly for separating milling elements from a worked suspension comprising several parts being movable with respect to each other and slots being formed between the parts.

Suspensions are milled or disperged by means of ball mills. The milling is performed by stirring a suspension being mixed with grinding balls. The suspension may be continuously pumped in and out. At the outlet the suspension is separated from the grinding balls, which have to remain in the mill, by a special device, which is called ball mill separator.

Assemblies according to the introductary clause are known e.g., from German Patent Nos. 2,446,341 C3 and 2,631,623 C2. The assembly according to German Patent No. 2,446,341 C3 comprises several annular rings, which are alternating fixed and movable. The movable rings are altogether mechanically connected to a vibrator. The distance between the rings is such that the grinding balls cannot pass. The vibrational movement eliminates the danger of clogging of the slits between the rings.

German Patent No. 2,631,623 C2 discloses a grinding ball separator consisting of a staple of narrowly spaced annular disks. The disks all have a common axis. Every second disk is rotatable in order to avoid clogging of the spaces. The disks may be connected to the stirring shaft or to a separate driving shaft. The rotation may be made automatically or manually.

A general and widespread problem of prior art grinding ball separators is the wear. Ball fragments that are smaller than the gaps between the rings can enter into the gaps and wear down the edges and surfaces. The damaged surfaces lead to lighter gaps and entry of larger fragments resulting in a further damage. At sometime the assembly has to be exchanged by a new one. Replacing the grinding ball separator means halting the process for a certain time altogether.

BROAD DESCRIPTION

SUMMARY OF THE INVENTION

It is the object of the invention to provide an assembly for separating milling elements from a worked suspension, minimal wear, having a compact structure and being quickly replacable.

The problem is solved by an assembly as mentioned above, which is characterized in that neighbouring parts engage each other, thereby being able to perform a limited relative movement in such a way that a first part continuously being moved within its total range of movement, the other parts successively following in a chain reaction-like delayed, discontinuous movement.

A feature of the invention is that the movement of neighbouring parts is limited (e.g., to a rotation of 90°) such that the wear that mainly goes back to the effect of milling fragments between moving parts, is strongly reduced. In order to achieve the anti-clogging effect, a discontinuous, short movement with long inactive intervals is sufficient.

According to a preferred embodiment, the movable parts comprise interleaving nested rings arranged concentrically.

The rings are annular and preferably in the same geometric plane. This leads to a very compact structure. It is possible to build small scale separators as well as large scale separators. The more rings there are, the more slots are formed and the higher is the amount of suspension passing per time unit. The annular rings are loosely connected. The assembly can therefore easily be decomposed after the innermost or outermost part has been removed. Intermediate parts can therefore easily be replaced. It is a further advantage of the invention that the separator can work even though one or more slots are clogged and the respective neighbouring parts are not any more movable relative to each other. Since the total range of movement of the first part is the sum of all relative movements, it is possible to detect if any two parts are wedged, without the assembly having to be removed and decomposed.

There are preferably engagement elements of the rings extending in a radial outward or inward direction and being freely movable to and fro between limiting elements of the outer or inner ring respectively. The engagement elements and the limiting elements are in combination with each other responsible for the loose connection between neighbouring parts. The limited movement is, e.g., a rotation in the range of 30° to 180° around the central axis. The limiting elements may be formed by protruding parts or by walls of a recess of the neighbouring part.

Generally speaking, the movement of the rings may be a rotational one (as indicated above) or a translational one. The latter is preferably in a axial direction. The engagement elements may be pins sliding in elongate slots or recesses. The cleaning movement of all rings or tubular elements is then a telescopic one.

Preferably, at least one ring is held exclusively by its neighbouring parts. Such a ring can be replaced by a minimal effort no implement being required for taking the ring away after removing the innermost or outermost ring. This is particularly advantageous for an assembly comprising as many as five or more nested rings.

A central shaft may be provided for driving the movable parts. The central shaft is engaged with its neighbouring ring in the same manner as other rings engage each other. The shaft may be operated manually or automatically. For a manual operation a handle is mounted on said shaft for rotating the movable parts. The handle being operated only from time to time for declogging the slots. The chain reaction-like movement of the rings may also be initiated by a rotation of the outermost ring the inner rings following successively in a delayed discontinuous manner.

The interleaving of neighbouring parts is preferably such that a relative rotation of 30° to 120°, more preferably about 60° to 90°, is possible, the central shaft turning as much as the cumulation of all relative rotations. If the central shaft cannot perform the total range of movement, this will be an indication of any sort of wedging. Such a wedging may be caused by a grinding ball fragment in the intermediate slots.

Accordingly an automatic control may be implemented by connecting an automatic drive (e.g., stepper motor) to the shaft and controlling the total amount of rotation of the shaft when applying a predetermined maximum torque. A torque limiting clutch may limit the momentum of torsion transmitted from the drive to the shaft. When the mechanical resistance is too high (which may be an indication of wedged parts) the clutch releases.

The assembly of the invention is preferably mounted in one arm of an L- or T-shaped pipe connector to form a device threadable to the outlet of the grinding chamber.

A suspension milling plant according to the invention comprises a grinding chamber for working a suspension and an assembly as described herein above, which is located at the axially arranged outlet of the grinding chamber. The diameter of the outlet is small compared with the diameter of the grinding chamber. Since the outlet is arranged near the longitudinal axis where the velocity of the balls is minimum, the wear of the ball mill separator is very low.

BRIEF DESCRIPTION OF THE DRAWINGS

The invention will now be explained in more details by means of a preferred embodiment in connection with the drawings.

In the drawings, same elements are designated with same reference numerals.

PREFERRED EMBODIMENT

Figure 1:
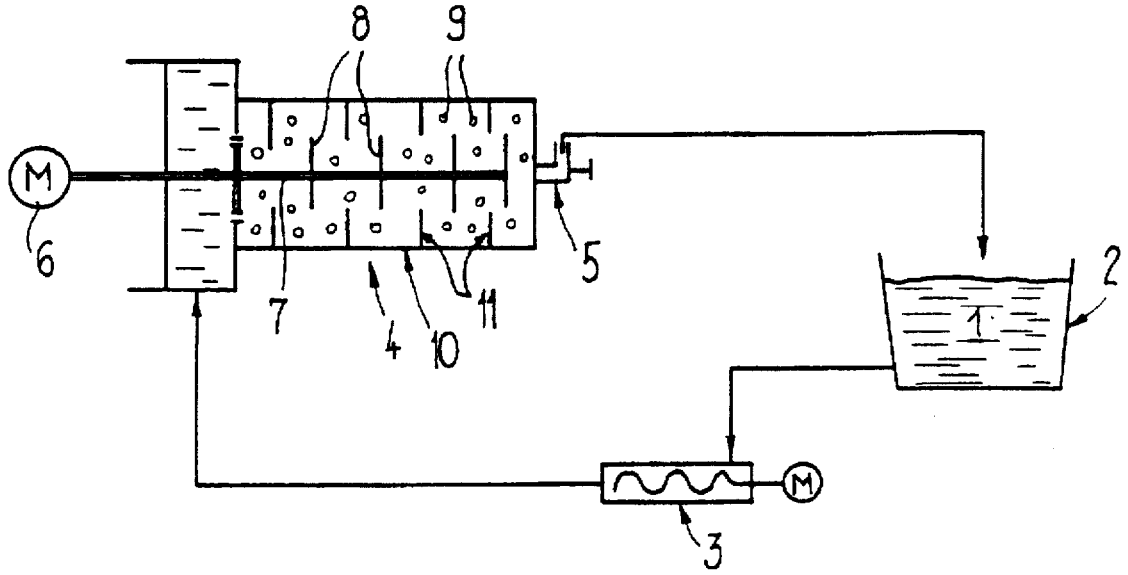
FIG. 1 shows a diagrammatic scheme of a ball mill plant for working a suspension.

With reference to FIG. 1, a suspension 1 in a tank 2 is fed to a pump 3 pumping the suspension into a mill 4. In the mill 4, the suspension 1 is worked by balls 9. The suspension 1 is leaving the mill 4 continuously through a ball separator 5 and is flowing back to the tank 2. The suspension 1 can therefore repeatedly be worked by the mill 4.

The pump 3 is sufficiently strong for compensating the pressure drop that occurs in the pipelines and the ball mill 4.

The mill 4 comprises a cylindrical wall 10 and a centrally arranged axis 7. Several stirring elements 8 are mounted on the axis 7 in order to stir the suspension 1 and the milling balls 9. A motor 6 is driving the axis 7 at a constant speed. At the inside of the wall 10, there are several fixed elements 11 enhancing the effect of the stirring elements 8 as known from the prior art.

The outlet of the mill 4 is arranged on or near the axis of the cylindrical wall 10. This has the advantage, that the balls 9 have low speed near the outlet, which in turn reduces the wear of the ball separator 5.

Figure 2:
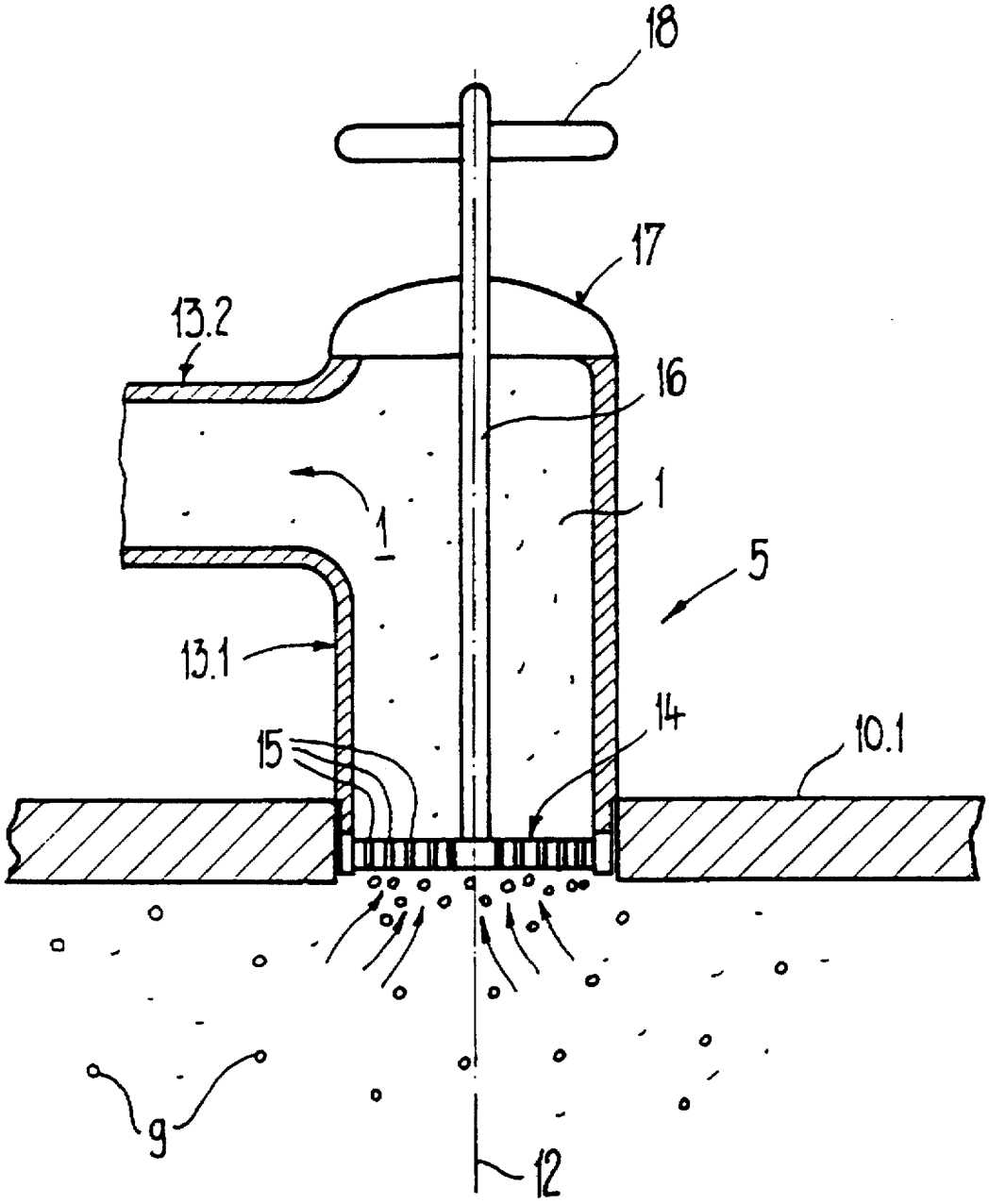
FIG. 2 diagrammatically shows a discontinuous moving ring separator.

FIG. 2 shows the ball mill separator in more details. The reference numeral 12 designates the central axis of the cylindrical wall 10. The flat bottom wall 10.1 has a threaded outlet for threading in a first arm 13.1 of a pipe connection. A second arm 13.2 of the pipe connection is rectangular to the first arm 13.1. It is connected to a duct leading back to the tank 2 (see FIG. 1).

A discontinuous moving rings separator 14 is mounted in the first arm 13.1. It is manually driven by a shaft 16 centrally arranged in the arm 13.1. The shaft 16 is penetrating a shaft end seal 17, a handle 18 being fixed to the shaft end outside the shaft end seal 17.

The suspension 1 is leaving the ball mill through narrow slots 15 in the ring separator 14. The slots 15 are sufficiently narrow to keep back the balls 9, which may have a diameter of 1 to 3 mm.

Figure 3:
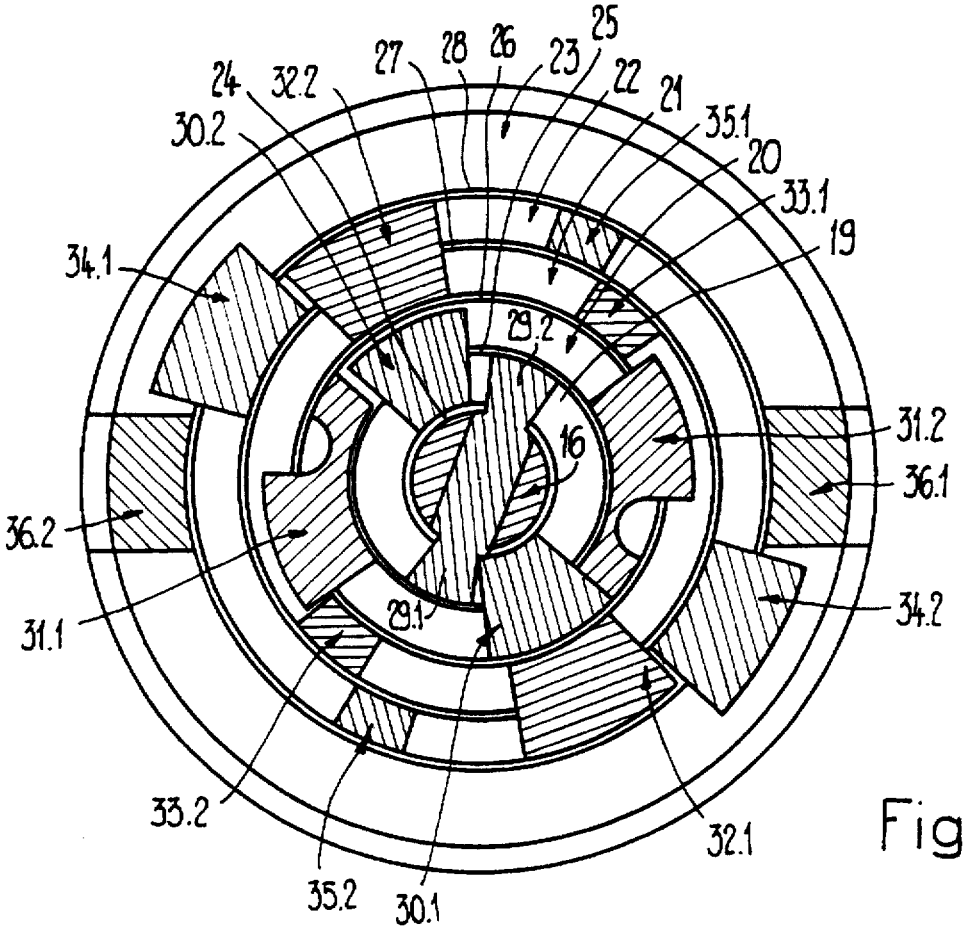
FIG. 3 shows a top plan view of the nested rings of the ball mill separator.

FIG. 3 shows a top plan view of the ring separator. Five rings 19, . . . , 23 are nested within each other, slots 24, . . . , 28 being provided between them.

The central shaft 16 and each ring 19, . . . , 23 have engagement elements 29.1, 29.2, . . . , 36.1, 36.2 providing the engagement between the nested rings according to the invention.

Figure 4:
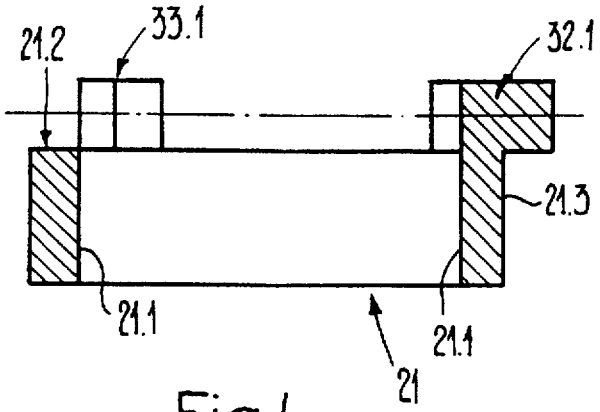
FIG. 4 shows a ring.

FIG. 4 shows the ring 21, the other rings 19, 20, 22, 23 being of similar form and property. At its (in FIG. 4 upper) side face the engagement elements 32.1 and 32.2 (in FIG. 4 not shown) are located at diametrically opposite positions (see FIG. 3). The engagement element 32.1 has, e.g., the shape of a short annular ring segment. It protrudes radially beyond the outer face 21.3 of the ring 21 thereby being engagable with the engagement elements 34.2 and 35.2 (see FIG. 3). The engagement element 32.1 is slidably resting on the side face of the next coming outer ring 22. The engagement elements 32.1, 32.2 do, however, not radially protrude beyond the inner face 21.1 of the ring 21. The engagement elements 33.1, 33.2 do not protrude neither beyond the outer face 21.3 nor beyond the inner face 21.1 of the ring 21. They may have the same or a smaller dimension in the radial direction as the ring 21.

Figure 5:
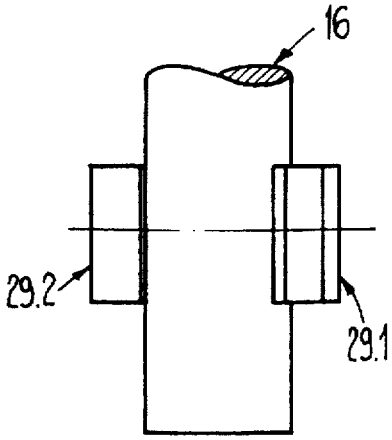
FIG. 5 shows the shaft with engagement elements for operating the discontinuous moving ring separator.

FIG. 5 shows the end of the shaft 16 having two outwardly protruding engagement elements 29.1, 29.2.

With reference to FIG. 3, the shaft 16 is going through the innermost ring 19, the engagement elements 29.1, 29.2 sliding on the side face of the ring 19, the movement being limited by the engagement elements 30.1, 30.2. The ring 19 has also two engagement elements 30.1, 30.2 sliding on the side face of the ring 20 and alternatively engaging the engagement elements 31.1, 31.2 of the ring 20.

The rings 20, 21, 22 are engaging with their neighbouring rings 21, 22, 23 respectively by means of the corresponding engagement elements 31.1, 31.2, . . . , 36.1, 36.2. The rings are thereby nested within each other in one common geometric plane.

It is evident that the intermediate rings 19, . . . , 22 are exclusively held by their neighbouring parts (shaft 16/ring 20, rings 19/21, rings 20/22, rings 21/23) by means of the engagement elements 29.1, 29.2, . . . , 36.1, 36.2. If the shaft 16 and the outermost ring 23 are rotatably mounted in an axially fixed position, the intermediate rings 19, . . . , 22 cannot get lost but still have a rotational freedom. It should be noted, that the intermediate rings are simply held by their neighbouring rings no further connection being necessary.

The engagement elements 29.1, 29.2, . . . , 36.1, 36.2 are shaped as annular ring segments with a central angle ("angle of aperture") of, e.g., 20° to 30° . As easily can be derived from FIG. 3 the angle of relative rotation of neighbouring rings is preferably between 30° and 120° , more preferably between 60° and 90° . The shaft 16, e.g., may turn about 120° with respect to the neighbouring ring 19. The ring 19 inturn may rotate about 60° with respect to the neighbouring ring 20. The same applies to the relative rotation between the rings 20 and 21, 21 and 22. Finally, the rings 22 and 23 have an angle of relative rotation of about 120° .

It will be clear for a person skilled in the art, that the angles shown in FIG. 3 are not of limiting character but are only meant as an example for illustrating the invention.

Figure 6:
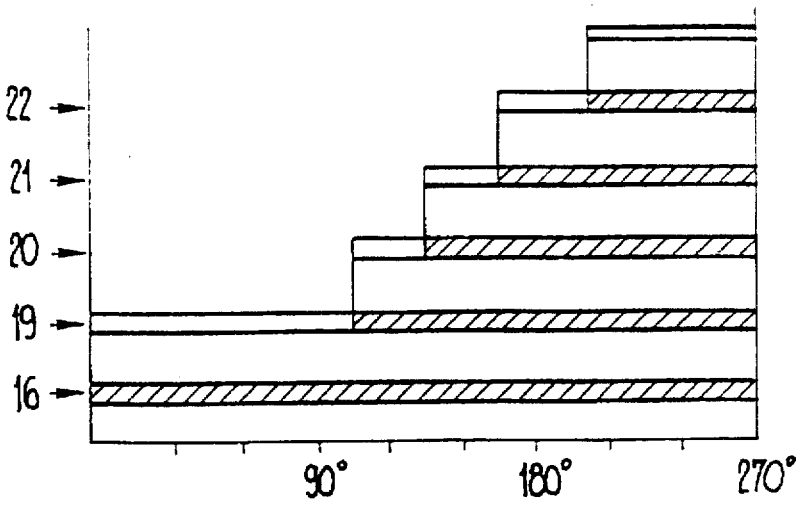
FIG. 6 shows a schematic diagramm of the movement of the rings, the horizontal axis indicating the rotational angle.

According to the invention the handle 18 is preferably operated manually. The discontinuously moving ball mill separator will then act as follows (see FIGS. 3 and 6):

When the shaft 16 is turned clockwise, it will perform a rotation of about 120° on its own, the engagement elements 29.1, 29.2 sliding on the side face of the ring 19, but not turning the ring 19. This leads to a relative movement between shaft 16 and ring 19.

When the engagement element 29.1 is contacting the engagement element 30.2 and the engagement element 29.2 is contacting the engagement element 30.1, the relative movement between shaft 16 and ring 19 stops and the ring 19 will turn together with the shaft 16, the engagement elements 30.1, 30.2 sliding on the side face of the ring 20 but leaving the ring 20 still. However, when the engagement elements 30.1, 30.2 engage the engagement elements 31.1, 31.2 the relative movement between the two rings 19 and 20 will stop and the ring 20 will be turned at the same rate as the ring 19. The ring 21 will not yet turn. However, when the engagement elements 31.1, 31.2 engage the engagement elements 32.2, 32.1, the ring 21 will start to move, the relative movement between the rings 20 and 21 being completed. And this goes on for the rest of the rings.

When the engagement elements 34.1 and 34.2 reach the engagement elements 36.1, 36.2, the shaft 16 cannot be turned any further. Since the outermost ring 23 is fixed, it will stop the rotational movement of the shaft and the rings altogether. The end of the range of rotation of the shaft 16 is reached. From the above it will be clear, that the total range of rotation may be, e.g., 270° , corresponding to the sum of all angles of relative rotation. The rings 19, . . . , 22 move the less the more outside their position is.

Therefore, the shaft 16 is initiating a chain reaction-like, discontinuous movement of the rings. This cascaded movement is sufficient to eliminate the danger of clogging of the slots 24, . . . , 28. Later on, the operator may turn the shaft 16 counter clockwise, thereby initiating a chain reaction-like discontinuous movement in the counter clockwise direction.

If two neighbouring rings are wedged and do not any more allow a relative movement, the operator will be able to detect this problem immediately, because the total amount of rotation of the shaft 16 will be less than the maximum range of, e.g., 270° if two rings are wedged. He will then remove the outermost ring 23 or the shaft 16. Afterwards he can take out the intermediate rings without having to use any special equipment, because the rings are resting loosely within each other. This is the reason, why the ball mill separator according to the invention is very easy to handle.

The manual operation may be replaced by an automatic driving and control system. A stepper motor will then drive the shaft, a torque limiting clutch being interposed between stepper motor and shaft. The stepper motor will be driven such that the shaft will perform the full range of rotation (e.g., 270° ). The direction of rotation will alternatingly be clockwise and counter clockwise, a long inactive time interval being provided between the rotational actions. Therefore the rings will only move spearingly. This results in a low wear. The time interval during which the motor is inactive is to be chosen such, that the clogging will not be too much. (If no clogging at all will occur during the time interval, the interval may be increased in order to reduce the wear, which only can take place during rotational action.)

In case two neighbouring rings are wedging, e.g., because a ball fragment is caught in the slot between the rings, the total amount of rotation reduces. Because of the torque limiting clutch, which will release the shaft if the torque applied by the motor goes beyond a predefined limit, the rings that are wedged will not be forced to rotate with respect to each other (such a forced rotation would lead to a forced wear). The fact, that the torque limiting clutch releases, can be detected by a control circuit. An alarm may be released (red lamp, sound generator etc.) informing the operator of the problem. Thus the automatic drive and control system can detect and avoid damages.

Figure 7:
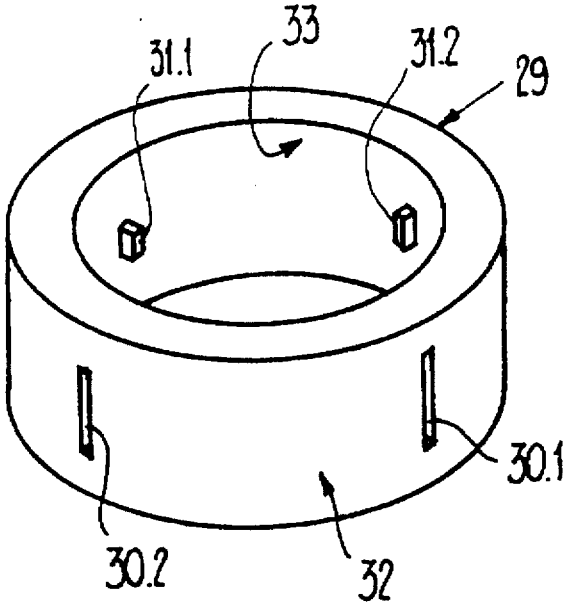
FIG. 7 shows a ring for an axially moving rings separator.

FIG. 7 shows a ring 29 for a separator with a telescopic movement in the axial direction. At its outer face 32, there are (e.g., four) elongate slots 30.1, 30.2 extending in the axial direction. Ribs 31.1, 31.2 are provided at the inner face 33 of the ring. The ribs 31.1, 31.2 are also directed in an axial direction. They are formed to engage with corresponding slots of a further ring (not shown) nested inside the ring of FIG. 7. In a similar manner an outer ring (not shown in FIG. 7) has ribs projecting into the slots 30.1, 30.2. Because the slots 30.1, 30.2 are longer than the corresponding ribs, the rings may perform a discontinuous axial movement beginning, e.g., with the innermost ring.

Figure 8A:
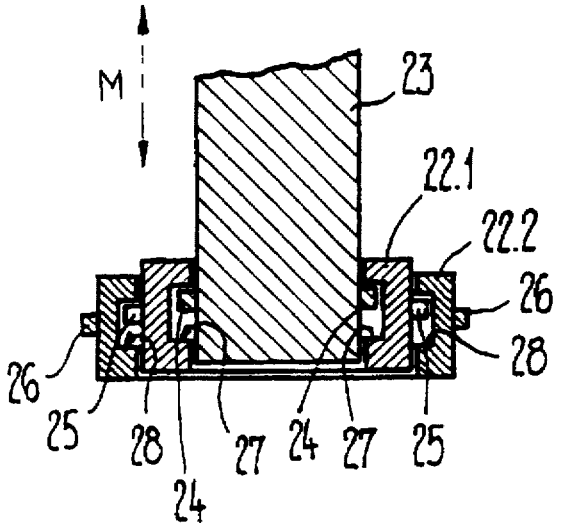
FIGS. 8*a* and *b* show diagrammatic sectional views of a second embodiment.
Figure 8B:
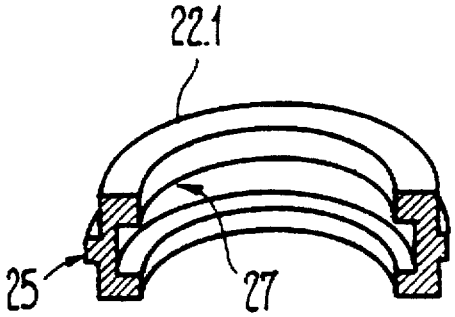

FIGS. 8*a* and 8*b* shows a further embodiment with a telescopic movement. The shaft 23 and the rings 22.1, 22.2 are engaging by means of a circumferentially provided ribs 24, 25, 26 resting in recesses 27, 28 of the neighbouring outer rings 22.1, 22.2 respecively.

It will now be evident, that a movement in the direction of the arrow M will lead to a telescopic relative movement of the rings 22.1, 22.2. If the recesses 27, 28 continuously go around the inner face of the corresponding rings 22.1, 22.2, a rotation of the shaft 23 will not be transferred to the outer rings. If the recesses do not go all around the rings, but have projections limiting a relative rotational movement in the sense of the first embodiment shown in FIGS. 3 to 5, a combined rotational and translational movement may be performed.

The invention is not limited to the embodiments described above. The engagement elements may, e.g., be implemented differently. There may be provided interacting recesses and pins taking up the function of engagement elements. The engagement elements may protrude in an radial inward direction instead of an outward direction. They may be mounted on the outer face (see, e.g., face 21.3, FIG. 4) instead of the side face. Further more the engagement between two neighbouring rings may be such that they may not be taken apart without removing a locking member or the like.

It is also possible to hold fast the central shaft or element and to drive the outermost ring. The chain reaction-like movement will then start from outside and successively continue to the inside (whereas it is in the other way round in the embodiment shown in FIG. 3).

The more rings there are, the more slots there are and therefore the higher is the throughput at a certain pressure drop.

The invention provides a new working principle of a separator for ball mills (namely a discontinuously moving rings separator, DMRS). The assembly is easy to manufacture and compact with respect to the amount of space needed.

I claim:

1. In an apparatus for separating milling elements from a worked suspension, said apparatus including a vessel for holding said worked suspension, an assembly comprising at least a first part, a third part and an intermediate part disposed between said first and third parts, said parts including engagement means for engaging an adjacent part, slots being formed between adjacent pairs of parts, said parts having a relative movement in such a way that when said first part is continuously moved within its total range of movement, said continuous movement of the first part progresses until said engagement means of the first part contacts said engagement means of the intermediate part and said relative movement between the first and intermediate part stops, and said first and intermediate parts move together in a relative movement until said engagement means of the intermediate part contacts said engagement means of the third part resulting in a delayed, chain reaction-like discontinuous movement, said assembly being located in said vessel.

2. The apparatus according to claim 1 wherein said first part is an inner part, relative to said intermediate and third parts.

3. The apparatus according to claim 1 wherein said first part is an outer part, relative to said intermediate and third parts.

4. The apparatus according to claim 1 wherein said parts comprise interleaving nested rings concentrically around one of said parts, which is centrally located.

5. The apparatus according to claim 4 wherein said engagement means protrude in a radial outward or inward direction and are freely movable to and fro between limiting elements of an outer or an inner ring, respectively, of said rings.

6. The apparatus according to claim 1 further comprising a central shaft which is rotatable to a limited degree and which is provided for driving said parts in a telescopic manner, or a rotational manner, or a telescopic and rotational manner.

7. The apparatus according to claim 6 wherein the adjacent said parts are rotatable and have a freedom of rotation in the range of 30° to 120° , and wherein said central shaft is rotatable as much as the cumulation of all of the ranges of the ranges of relative movements.

8. An apparatus for separating milling elements from a worked suspension, said apparatus comprising a vessel for holding said worked suspension, and an assembly which comprises at least a first part, a third part and an intermediate part disposed between said first and third parts, said parts including engagement means for engaging an adjacent part, slots being formed between adjacent pairs of parts, said parts having a relative movement in such a way that when said first part is continuously moved within its total range of movement, said continuous movement of the first part progresses until said engagement means of the first part contacts said engagement means of the intermediate part and said relative movement between the first and intermediate part stops, and said first and intermediate parts move together in a relative movement until said engagement means of the intermediate part contacts said engagement means of the third part resulting in a delayed, chain reaction-like discontinuous movement, said assembly being located in said vessel.

9. The apparatus according to claim 8 wherein said parts comprise interleaving nested rings concentrically around one of said parts, which is centrally located.

10. The apparatus according to claim 9 wherein said engagement means protrude in a radial outward or inward direction and are freely movable to and fro between limiting elements of an outer or an inner ring, respectively, of said rings.

11. The apparatus according to claim 10 wherein at least one of said rings is held exclusively by its adjacent said rings.

12. The apparatus according to claim 11 further comprising a central shaft which is rotatable to a limited degree and which is provided for driving said parts in a telescopic manner, or a rotational manner, or a telescopic and rotational manner.

13. The assembly according to claim 12 wherein said central shaft is connected to an automatic drive which controls a total amount of rotation of said central shaft when applying a predetermined torque.

14. The apparatus according to claim 12 wherein a handle is mounted on said central shaft for manually operating said parts.

15. The apparatus according to claim 14 wherein the adjacent said parts are rotatable and have a freedom of rotation in the range of 30° to 120° , and wherein said central shaft is rotatable as much as the cumulation of all of the ranges of the ranges of relative movements.

16. The assembly according to claim 15 wherein said central shaft is connected to an automatic drive which controls a total amount of rotation of said central shaft when applying a predetermined torque.

17. The apparatus according to claim 15 wherein said central shaft is connected to an automatic drive which controls the total amount of rotation of said central shaft when applying a predetermined torque.

18. The apparatus according to claim 8 wherein said vessel is a grinding chamber having an outlet, and the assembly is arranged so as to be axially disposed at said outlet of said grinding chamber.

19. The apparatus according to claim 8 wherein said assembly is mounted in an arm of a L- or T-shaped pipe connector.

20. The apparatus according to claim 19 wherein said parts comprise interleaving nested rings arranged concentrically around one of said parts, which is centrally located and which is a central shaft which is rotatable to a limited degree, said shaft being a straight handle shaft, a first end of said shaft which is opposite of said rings, penetrating through said pipe in a sealed manner adapted to facilitate rotation of said shaft.

21. The apparatus according to claim 8 wherein said first part is an inner part, relative to said intermediate and third parts.

22. The apparatus according to claim 8 wherein said first part is an outer part, relative to said intermediate and third parts.

* * * * *